US011465421B2

(12) United States Patent
Ishihara et al.

(10) Patent No.: US 11,465,421 B2
(45) Date of Patent: Oct. 11, 2022

(54) INKJET PRINTER

(71) Applicant: Roland DG Corporation, Hamamatsu (JP)

(72) Inventors: Masanori Ishihara, Hamamatsu (JP); Yuta Fujisawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/350,038

(22) Filed: Jun. 17, 2021

(65) Prior Publication Data

US 2021/0394527 A1 Dec. 23, 2021

(30) Foreign Application Priority Data

Jun. 18, 2020 (JP) ..... JP2020-105172

(51) Int. Cl.

| | |
|---|---|
| ***B41J 11/02*** | (2006.01) |
| ***B41J 2/21*** | (2006.01) |
| ***B41J 2/045*** | (2006.01) |
| ***B41J 2/17*** | (2006.01) |
| *B41J 2/02* | (2006.01) |

(52) U.S. Cl.

CPC ..... *B41J 2/2114* (2013.01); *B41J 2/04501* (2013.01); *B41J 2/17* (2013.01); *B41J 2002/022* (2013.01)

(58) Field of Classification Search

CPC . B41J 11/002; B41J 11/0021; B41J 11/00212; B41J 11/00214; B41J 11/00218

See application file for complete search history.

(56) References Cited

U.S. PATENT DOCUMENTS

2011/0134179 A1 6/2011 Otsuka et al.
2015/0224793 A1 8/2015 Tsuchiya
(Continued)

FOREIGN PATENT DOCUMENTS

EP 2641747 A1 * 9/2013 ..... B41J 11/002
JP 2005-199457 A 7/2005
(Continued)

OTHER PUBLICATIONS

Hashizume et al., MachineTranslationofJP-2009202418-A, 2009 (Year: 2009).*

*Primary Examiner* — Scott A Richmond
(74) *Attorney, Agent, or Firm* — Keating & Bennett, LLP

(57) ABSTRACT

An inkjet printer includes a first light applicator disposed in a second scanning direction relative to a recording head. The first light applicator includes a first upstream light source group at a location corresponding to a location of the recording head in a movement direction of a recording medium, and a first downstream light source group on a downstream side in the movement direction of the recording medium relative to the recording head. The inkjet printer turns off the first upstream light source group and turns on the first downstream light source group during movement of a carriage in a first scanning direction and discharge of first ink from the recording head, and turns on the first upstream light source group and the first downstream light source group during movement of the carriage in the second scanning direction after discharge of the first ink.

5 Claims, 7 Drawing Sheets

(56) References Cited

U.S. PATENT DOCUMENTS

| | | | | |
|---|---|---|---|---|
| 2015/0231892 | A1* | 8/2015 | Mochizuki | B41J 11/00218 347/12 |
| 2017/0072706 | A1 | 3/2017 | Okawa | |
| 2018/0065381 | A1* | 3/2018 | Takasugi | B41J 11/00218 |
| 2020/0276833 | A1 | 9/2020 | Mezaki | |
| 2021/0031541 | A1* | 2/2021 | Mezaki | B41J 11/00216 |

FOREIGN PATENT DOCUMENTS

| | | | | |
|---|---|---|---|---|
| JP | 2009-202418 | A | | 9/2009 |
| JP | 2009202418 | A | * | 9/2009 |
| JP | 2012-224020 | A | | 11/2012 |
| JP | 2014-065287 | A | | 4/2014 |
| JP | 2014-117799 | A | | 6/2014 |
| JP | 2015-186918 | A | | 10/2015 |
| JP | 2016-047652 | A | | 4/2016 |
| JP | 2019-069593 | A | | 5/2019 |
| WO | 2009/148074 | A1 | | 12/2009 |

* cited by examiner

INKJET PRINTER

CROSS REFERENCE TO RELATED APPLICATIONS

This application claims the benefit of priority to Japanese Patent Application No. 2020-105172 filed on Jun. 18, 2020. The entire contents of this application are hereby incorporated herein by reference.

BACKGROUND OF THE INVENTION

1. Field of the Invention

The present invention relates to inkjet printers.

2. Description of the Related Art

Inkjet printers known in the related art discharge photo-curable ink onto recording media and apply light to the photo-curable ink discharged, thus forming images on the recording media. For such inkjet printers, various techniques have been developed regarding positional relationships between light applicators and recording heads to discharge photo-curable ink and temporal relationships between ink discharge timings and light application timings.

JP 2009-202418 A, for example, discloses an inkjet printer including: a support that supports a recording medium; a carriage that moves in a right-left direction and a front-rear direction above the support; a recording head mounted on the carriage; and a UVLED unit (ultraviolet light source) mounted on the carriage. The recording head of the inkjet printer described in JP 2009-202418 A discharges ultraviolet-curable ink while the recording head reciprocates in the right-left direction together with the carriage. During this process, the UVLED unit applies ultraviolet light for semi-curing (or temporary curing) onto a region rearward of the recording head in the direction of movement of the carriage. The ultraviolet light for semi-curing is thus applied to the ink discharged. The carriage is then moved forward. Ink landing positions thus move in the front-rear direction of the recording medium. The UVLED unit of the inkjet printer described in JP 2009-202418 A applies ultraviolet light for full curing onto a region rearward of the recording head before forward movement of the carriage. Consequently, the ultraviolet light for full curing is applied to the ink that has previously been discharged and semi-cured.

Light for semi-curing is generally known to be feeble light that is weaker than light for full curing.

According to JP 2009-202418 A, applying ultraviolet light for semi-curing to ink is assumed to prevent ink of different colors from mixing and blurring. According to JP 2009-202418 A, semi-cured ink gradually spreads and smoothens on the recording medium. Curing the smoothened ink in the semi-cured state by applying ultraviolet light for full curing thereto is assumed to enable glossy printing.

If photo-curable ink is semi-cured immediately after having landed on a recording medium and is then fully cured, however, a resulting print image may not be glossy enough depending on conditions. This is because if photo-curable ink is semi-cured immediately after having landed on a recording medium, the surfaces of ink dots will be cured but the inner portions of the ink dots will not be cured. If the ink dots wet and spread in this state, wrinkles may occur at the surfaces of the semi-cured ink dots, so that the ink dots do not necessarily become smoothened. A phenomenon in which semi-cured ink dots wet and spread will hereinafter be referred to as "flattening". As used herein, the term "smoothen" refers to a state where an ink surface has few irregularities. Stacking layers of ink in a semi-cured state makes it more difficult for the inner portions of underlying ink layers to be cured. This results in a phenomenon in which ink dots do not smoothen. Flattening of ink and smoothening of ink are thus not necessarily compatible. If ink does not spread and flatten moderately, however, printing will be "matte printing", and graininess of ink dots will remain on a print image.

SUMMARY OF THE INVENTION

Accordingly, preferred embodiments of the present invention provide inkjet printers that each enable ink to flatten moderately and smoothen suitably.

An inkjet printer according to a preferred embodiment of the present invention includes a support table on which a recording medium is to be placed; a carriage facing the support table; a medium mover to move the recording medium placed on the support table in a predetermined movement direction relative to the carriage; a carriage mover to move the carriage in a first scanning direction and a second scanning direction perpendicular or substantially perpendicular to the movement direction of the recording medium; a recording head provided on the carriage; a first light applicator provided on the carriage; and a controller to control the medium mover, the carriage mover, the recording head, and the first light applicator. The recording head includes first nozzles each to discharge photo-curable first ink toward the support table. The first ink is process color ink. The first light applicator includes first light sources each to produce light that cures the first ink. The first light applicator is disposed in the second scanning direction relative to the recording head. The first light sources include a first upstream light source group and a first downstream light source group. The first upstream light source group is provided at a location corresponding to a location of the recording head in the movement direction of the recording medium. The first upstream light source group includes one or more of the first light sources. The first downstream light source group is provided on a downstream side in the movement direction relative to the recording head. The first downstream light source group includes one or more of the first light sources. The controller includes a memory, a scanning controller, a discharge controller, a light source controller, and a movement controller. The memory stores print data. The scanning controller is configured or programmed to control the carriage mover in accordance with the print data so as to move the carriage in the first scanning direction and the second scanning direction. The discharge controller is configured or programmed to cause the recording head to discharge the first ink at least during movement of the carriage in the first scanning direction in accordance with the print data. The light source controller is configured or programmed to turn off the first upstream light source group and turn on the first downstream light source group during movement of the carriage in the first scanning direction and discharge of the first ink from the recording head in accordance with the print data, and turn on the first upstream light source group and the first downstream light source group during movement of the carriage in the second scanning direction after discharge of the first ink in accordance with the print data. The movement controller is configured or programmed to control the medium mover in accordance with the print data so as to move the recording medium to the downstream side in the movement direction every time the carriage moves in each of the first scanning direction and the second scanning direction at least once.

In an inkjet printer according to a preferred embodiment of the present invention, the first upstream light source group disposed rearward of the recording head in a carriage movement direction (i.e., disposed in the second scanning direction relative to the recording head) is off during movement of the carriage in the first scanning direction and discharge of the first ink from the recording head in accordance with the print data. Thus, the first ink discharged from the recording head is not cured immediately after being discharged.

In an inkjet printer according to a preferred embodiment of the present invention, the first upstream light source group disposed forward of the recording head in a carriage movement direction (i.e., disposed in the second scanning direction relative to the recording head) is on during movement of the carriage in the second scanning direction after discharge of the first ink. Thus, light is applied to the first ink that has landed on the recording medium during movement of the carriage in the first scanning direction. Accordingly, the first ink that has previously been discharged is cured. In other words, the inkjet printer applies light to the first ink after a lapse of a certain time from discharge of the first ink.

In an inkjet printer according to a preferred embodiment of the present invention, the first downstream light source group disposed downstream of the recording head in the movement direction of the recording medium is on during movement of the carriage in the first scanning direction and the second scanning direction. Thus, light is applied to the first ink that has already landed on the recording medium before reciprocation of the carriage at this point in time and has moved to the downstream side relative to the recording head in accordance with the movement of the recording medium. Consequently, the first ink that has previously landed on the recording medium is cured with reliability.

Because a certain time elapses between discharge of the first ink and application of light to the first ink, the first ink spreads and flattens moderately. After the first ink has flattened, the first upstream light source group disposed forward of the recording head in the carriage movement direction (i.e., disposed in the second scanning direction relative to the recording head) applies light to the first ink. The application of light to the first ink makes it difficult for the first ink from spreading. Wrinkles are thus unlikely to occur at the surfaces of ink dots of the first ink. Consequently, the first ink flattens moderately and smoothens suitably.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
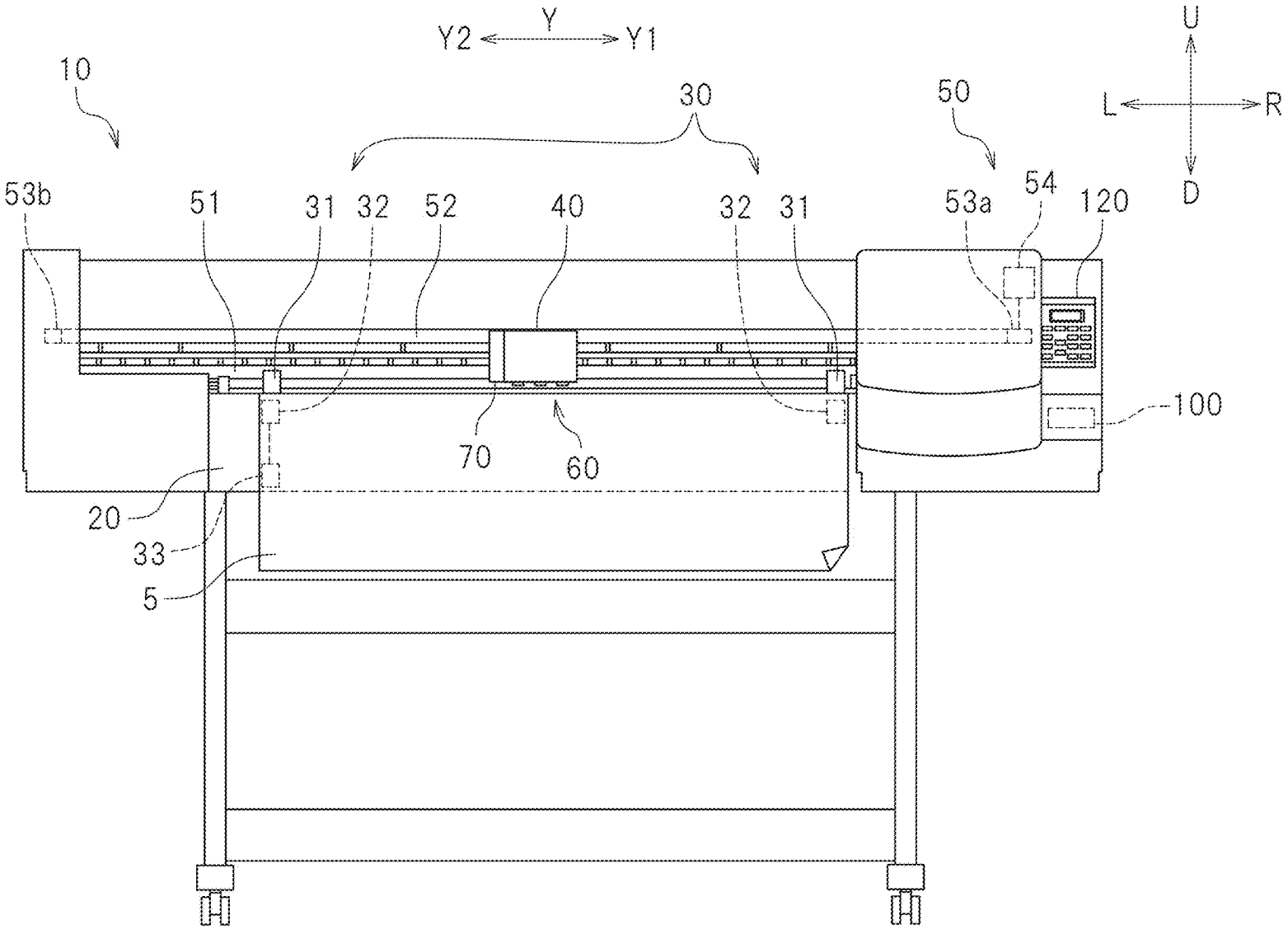
FIG. 1 is a front view of a printer according to a first preferred embodiment of the present invention.

Inkjet printers according to preferred embodiments of the present invention will be described below with reference to the drawings. The preferred embodiments described below are naturally not intended to limit the present invention in any way. Components or elements having the same functions are identified by the same reference signs, and overlapping description thereof will be omitted or simplified as appropriate. The following description is based on the assumption that when an inkjet printer is viewed from the front, a direction away from the inkjet printer is a forward direction, and a direction toward the inkjet printer is a rearward direction. The reference signs F, Rr, L, R, U, and D in the drawings respectively represent front, rear, left, right, up, and down. These directions, however, are defined merely for the sake of convenience of description and do not limit, for example, how the inkjet printer may be installed.

First Preferred Embodiment

FIG. 1 is a front view of a large format inkjet printer (hereinafter referred to as a "printer") 10 according to a first preferred embodiment of the present invention. The printer 10 moves a recording medium 5 in a roll form in a front-rear direction and discharges ink from a recording head 60 mounted on a carriage 40 that moves in a right-left direction. The printer thus prints an image on the recording medium 5. In the following description, the right-left direction in which the carriage 40 moves may also be referred to as a "scanning direction Y", and the front-rear direction in which the recording medium 5 moves may also be referred to as a "conveyance direction X" (see FIG. 2).

The recording medium 5 is an object on which an image is to be printed. The recording medium 5 is not limited to any particular type of recording medium. Examples of the recording medium 5 may include paper, such as plain paper and inkjet printing paper, and transparent sheets, such as a resin sheet and a glass sheet. The recording medium 5 may be a sheet, such as a metal sheet or a rubber sheet, or may be a fabric.

As illustrated in FIG. 1, the printer 10 includes a platen 20, a conveyor 30, the carriage 40, a carriage mover 50, the recording head 60, a light applicator 70, and a controller 100.

The platen 20 is an example of a support table on which the recording medium 5 is to be placed. As illustrated in FIG. 1, the platen 20 extends in the scanning direction Y.

The conveyor 30 is an example of a medium mover to move the recording medium 5, which is placed on the platen 20, in a predetermined movement direction relative to the carriage 40. In this preferred embodiment, the predetermined movement direction is the front-rear direction. The recording medium 5 on the platen 20 is moved in the front-rear direction by the conveyor 30. The conveyor 30 includes pinch rollers 31, grit rollers 32, and a feed motor 33. The pinch rollers 31 are provided above the platen 20 so as to press down the recording medium 5 from above. The platen 20 is provided with the grit rollers 32. The grit rollers 32 are disposed below the pinch rollers 31. The grit rollers 32 are provided at positions where the grit rollers 32 each face an associated one of the pinch rollers 31. The grit rollers 32 are coupled to the feed motor 33. The grit rollers 32 are rotatable upon receiving a driving force from the feed motor 33. The feed motor 33 is electrically connected to the controller 100. The feed motor 33 is controlled by the controller 100. With the recording medium 5 sandwiched between the pinch rollers 31 and the grit rollers 32, rotation of the grit rollers 32 conveys the recording medium 5 in the front-rear direction. The front-rear direction includes a direction toward the front and a direction toward the rear. The conveyance direction X includes a direction toward an upstream side X1 and a direction toward a downstream side X2 (see FIG. 2). In the following description, the direction toward the rear may also be referred to as the "direction toward the upstream side X1" as appropriate, and the direction toward the front may also be referred to as the "direction toward the downstream side X2" as appropriate. In the present preferred embodiment, printing is effected on the recording medium 5 while the recording medium 5 is moved from the upstream side X1 to the downstream side X2 in the conveyance direction X in an intermittent manner.

In this preferred embodiment, the conveyor 30 to convey the recording medium 5 in the conveyance direction X functions as the medium mover to move a recording medium in a predetermined movement direction relative to a carriage. The medium mover, however, is not limited to the conveyor 30. The medium mover is simply required to be configured or programmed such that the positional relationship between a recording medium and a carriage is changed in one direction by moving at least one of the recording medium and the carriage. In one example, the recording medium 5 may be immobile, and a carriage may be moved not only in a scanning direction but also in a direction perpendicular or substantially perpendicular to the scanning direction. In another example, the recording medium 5 may be fixed to a support table, and the support table may move in a direction perpendicular or substantially perpendicular to a carriage scanning direction as in a "flatbed printer". In either case, the term "downstream side in the movement direction of the recording medium" refers to the direction of movement of the recording medium with respect to the carriage during printing, and the term "upstream side in the movement direction of the recording medium" refers to a direction opposite to the movement direction of the recording medium with respect to the carriage during printing.

The carriage 40 is disposed above the platen 20. The carriage 40 is provided such that the carriage 40 faces the platen 20. The carriage 40 is supported by the carriage mover 50 such that the carriage 40 is movable in the scanning direction Y. As illustrated in FIG. 1, the carriage mover 50 includes a guide rail 51, a belt 52, a right pulley 53*a*, a left pulley 53*b*, and a carriage motor 54. The carriage 40 is in slidable engagement with the guide rail 51. The guide rail 51 extends in the right-left direction. The guide rail 51 guides movement of the carriage 40 in the right-left direction. The belt 52 is secured to the carriage 40. The belt 52 is an endless belt. The belt 52 is wound around the pulley 53*a* provided on the right side of the guide rail 51 and around the pulley 53*b* provided on the left side of the guide rail 51. The carriage motor 54 is attached to the right pulley 53*a*. The carriage motor 54 is electrically connected to the controller 100. The carriage motor 54 is controlled by the controller 100. Driving the carriage motor 54 rotates the pulley 53*a*, causing the belt 52 to move. This moves the carriage in the right-left direction along the guide rail 51. The right-left direction includes a direction toward the right and a direction toward the left. In the following description, the direction toward the right may also be referred to as a "first scanning direction Y1" as appropriate, and the direction toward the left may also be referred to as a "second scanning direction Y2" as appropriate. In the present preferred embodiment, the carriage mover 50 moves the carriage 40 in the first scanning direction Y1 and the second scanning direction Y2 each perpendicular or substantially perpendicular to the conveyance direction X of the recording medium 5.

Figure 2:
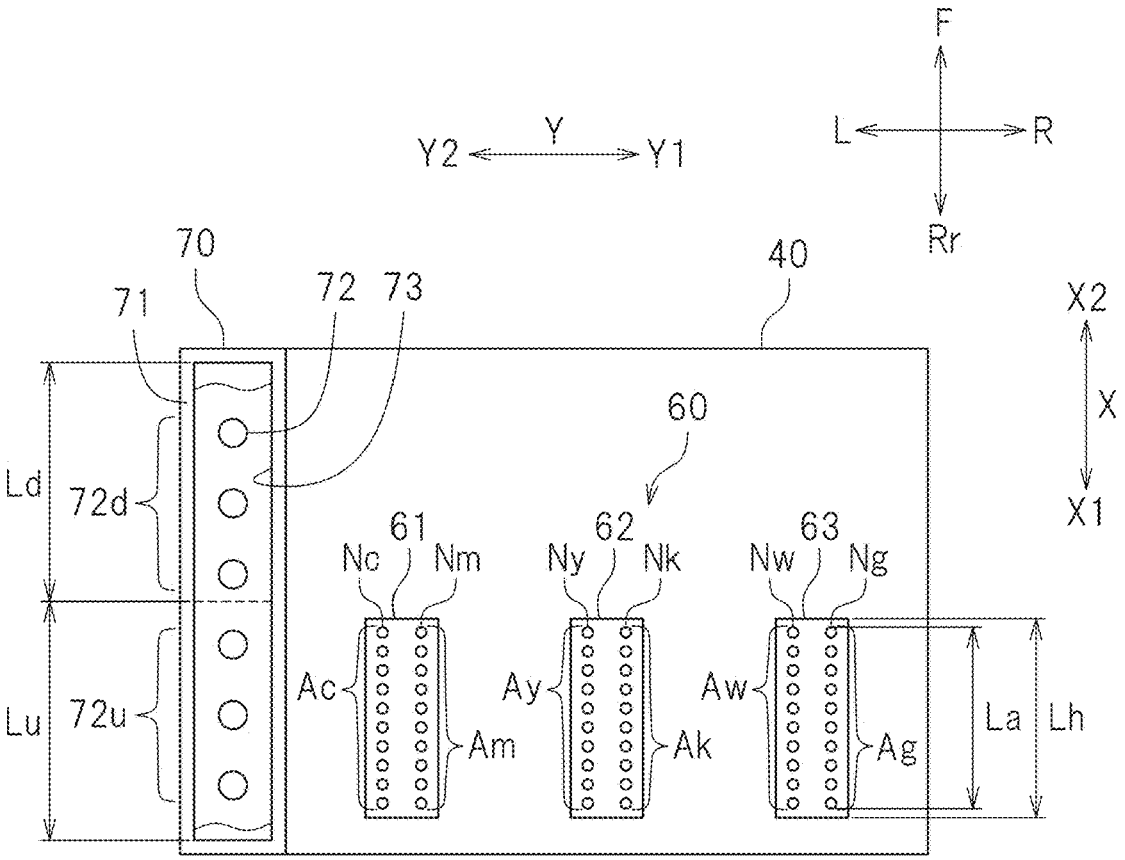
FIG. 2 is a partially cut-away plan view schematically illustrating the arrangement of components on the lower surface of a carriage.

The recording head 60 and the light applicator 70 are mounted on the carriage 40. FIG. 2 is a partially cut-away plan view schematically illustrating the arrangement of components on the lower surface of the carriage 40. As illustrated in FIG. 2, the recording head 60 is provided on the lower surface of the carriage 40. In this preferred embodiment, the recording head 60 includes a first ink head 61, a second ink head 62, and a third ink head 63. The first ink head 61, the second ink head 62, and the third ink head 63 are arranged in alignment with each other in the scanning direction Y. The first ink head 61, the second ink head 62, and the third ink head 63 each extend in the conveyance direction X.

As illustrated in FIG. 2, the first ink head 61 includes a nozzle row Ac in which nozzles Nc are arranged in alignment with each other in the conveyance direction X, and a nozzle row Am in which nozzles Nm are arranged in alignment with each other in the conveyance direction X. The lower surface of the first ink head 61 defines a nozzle surface provided with the nozzles Nc and the nozzles Nm. The nozzles Nc each discharge photo-curable cyan ink toward the platen 20. The nozzle row Ac is a nozzle row including the nozzles Nc from which cyan ink is to be discharged. The nozzles Nm each discharge photo-curable magenta ink toward the platen 20. The nozzle row Am is a nozzle row including the nozzles Nm from which magenta ink is to be discharged.

The second ink head 62 includes a nozzle row Ay in which nozzles Ny are arranged in alignment with each other in the conveyance direction X, and a nozzle row Ak in which nozzles Nk are arranged in alignment with each other in the conveyance direction X. The nozzles Ny each discharge photo-curable yellow ink toward the platen 20. The nozzles Nk each discharge photo-curable black ink toward the platen 20. Cyan ink, magenta ink, yellow ink, and black ink are each an example of process color ink. Process color ink to be discharged from the recording head 60, however, is not limited to cyan ink, magenta ink, yellow ink, or black ink.

The third ink head 63 includes a nozzle row Aw in which nozzles Nw are arranged in alignment with each other in the conveyance direction X, and a nozzle row Ag in which nozzles Ng are arranged in alignment with each other in the conveyance direction X. The nozzles Nw each discharge photo-curable white ink toward the platen 20. The nozzles Ng each discharge photo-curable gloss ink (transparent ink) toward the platen 20. White ink and gloss ink are examples of special color ink. In this preferred embodiment, gloss ink is ink to be used for a topcoat covering the surface of an image. Gloss ink, however, does not necessarily be used only for a topcoat. Gloss ink is not limited to any particular usage. White ink is used as ink for undercoating an image, for example, when the image is to be printed on a recording medium that is not white. White ink is also not limited to any particular usage. In this preferred embodiment, the locations of the nozzle rows Ac to Ag correspond to each other in the conveyance direction X.

In the present preferred embodiment, ink to be discharged from the recording head 60 is photo-curable ink. As used herein, the term "photo-curable ink" refers to ultraviolet-curable ink that is cured when ultraviolet light is applied thereto. The photo-curable ink is not limited to any particular component or components or any particular property or properties.

A method by which the recording head 60 discharges ink is not limited to any particular method. In the present preferred embodiment, the printer 10 is a printer that uses an inkjet method. In the present preferred embodiment, the term "inkjet method" refers to any of various inkjet methods known in the related art, including various continuous methods (such as a binary deflection method and a continuous deflection method) and various on-demand methods (such as a thermal method and a piezoelectric method).

The light applicator 70 is provided on the carriage 40. In the present preferred embodiment, the light applicator 70 is disposed in the second scanning direction Y2 relative to the recording head 60 (i.e., leftward of the recording head 60). As illustrated in FIG. 2, the light applicator 70 includes a case 71, light sources 72, and an application port 73. The case 71 has a box shape. The light sources 72 are housed in the case 71. The light sources 72 each produce light that cures the ink discharged from the recording head 60. In this preferred embodiment, the light sources 72 are light-emitting diodes (LEDs) that apply ultraviolet light. The light sources 72, however, are not limited to any particular type of light source. The light sources 72 are disposed in alignment with each other at equal intervals in the conveyance direction X.

The light sources 72 include an upstream light source group 72*u* and a downstream light source group 72*d*. The upstream light source group 72*u* is provided at a location corresponding to a location of the recording head 60 in the conveyance direction X. The upstream light source group 72*u* includes more than one light source 72. The number of light sources 72 included in the upstream light source group 72*u*, however, may be one. The downstream light source group 72*d* is provided on the downstream side X2 in the conveyance direction X relative to the recording head 60. The downstream light source group 72*d* includes more than one light source 72. The number of light sources 72 included in the downstream light source group 72*d*, however, may be one. In this preferred embodiment, the upstream light source group 72*u* and the downstream light source group 72*d* are adjacent to each other in the conveyance direction X. The upstream light source group 72*u* and the downstream light source group 72*d* are thus substantially continuous with each other. The light sources 72 are each electrically connected to the controller 100. The light sources 72 are each independently controlled by the controller 100. The controller 100, however, is simply required to be configured or programmed such that at least the upstream light source group 72*u* and the downstream light source group 72*d* are controllable independently.

The application port 73 is provided on the bottom surface of the case 71. The application port 73 is configured to allow light produced by the light sources 72 to pass through the application port 73. In this preferred embodiment, the application port 73 is an opening provided with a cover that allows passage of light therethrough. The application port 73, however, may be a simple opening not covered with any member, such as a cover. The application port 73 extends in the conveyance direction X. In the present preferred embodiment, an end of the application port 73 facing the upstream side X1 in the conveyance direction X is located on the upstream side X1 relative to an end of the upstream light source group 72*u* facing the upstream side X1. An end of the application port 73 facing the downstream side X2 in the conveyance direction X is located on the downstream side X2 relative to an end of the downstream light source group 72*d* facing the downstream side X2. The length of the application port 73 in the conveyance direction X is longer than the sum of the length of the upstream light source group 72*u* in the conveyance direction X and the length of the downstream light source group 72*d* in the conveyance direction X. The light produced by the upstream light source group 72*u* and the downstream light source group 72*d* is applied to at least an area where the application port 73 is provided in the conveyance direction X.

As illustrated in FIG. 2, a length Lu of an area to which the upstream light source group 72*u* applies light in the conveyance direction X is longer than a length Lh of the recording head 60 in the conveyance direction X. A length Ld of an area to which the downstream light source group 72*d* applies light in the conveyance direction X is also longer than the length Lh of the recording head 60 in the conveyance direction X. The length Lu of the area to which the upstream light source group 72*u* applies light in the conveyance direction X and the length Ld of the area to which the downstream light source group 72*d* applies light in the conveyance direction X, however, may each be longer than a length La of each of the nozzle rows Ac to Ag in the conveyance direction X and may each be shorter than the length Lh of the recording head 60 in the conveyance direction X. A boundary between the area to which the upstream light source group 72*u* applies light and the area to which the downstream light source group 72*d* applies light is defined for the sake of convenience. In this preferred embodiment, the boundary is assumed to be located between the light source 72 included in the upstream light source group 72*u* and disposed closest to the downstream side X2 in the conveyance direction X and the light source 72 included in the downstream light source group 72*d* and disposed closest to the upstream side X1 in the conveyance direction X.

As illustrated in FIG. 1, a control panel 120 is provided on the right end of the printer 10. The control panel 120 is provided with, for example, a display to present a device status and input keys to be operated by a user.

Figure 3:
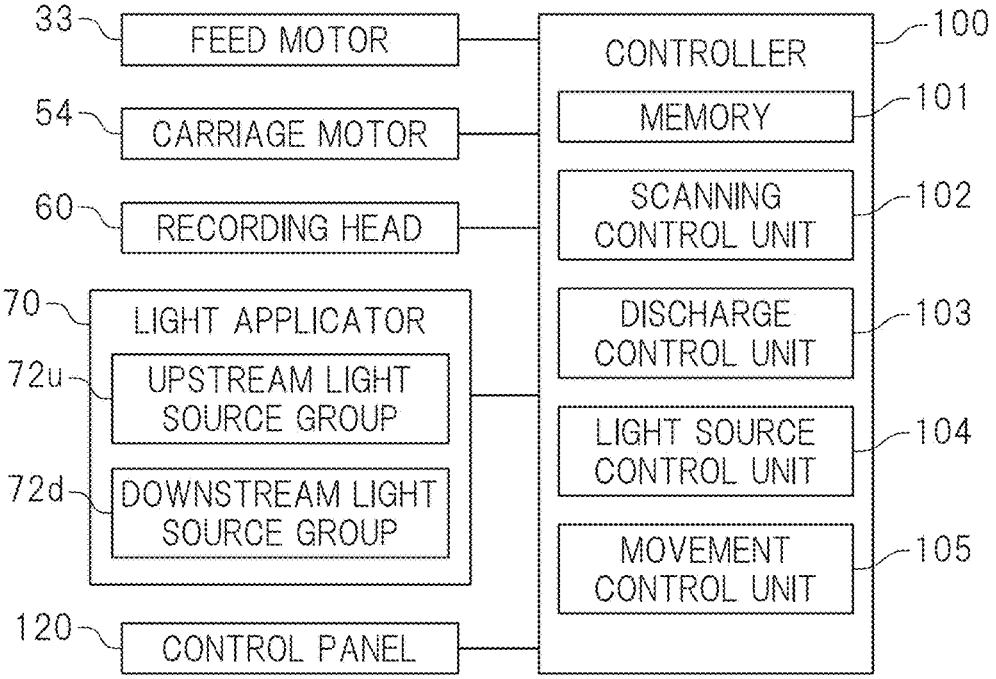
FIG. 3 is a block diagram of the printer.

The control panel 120 is connected to the controller 100. FIG. 3 is a block diagram of the printer 10 according to the present preferred embodiment. As illustrated in FIG. 3, the controller 100 is electrically connected to the feed motor 33, the carriage motor 54, the recording head 60, the upstream light source group 72*u* and the downstream light source group 72*d* of the light applicator 70, and the control panel 120. The controller 100 is thus configured or programmed to be able to control these components.

The controller 100 is not limited to any particular configuration. The controller 100 is, for example, a microcomputer. The microcomputer is not limited to any particular hardware configuration. In one example, the microcomputer may include an interface (I/F) to receive print data and/or other data from an external device, such as a host computer; a central processing unit (CPU) to execute commands included in a control program; a read-only memory (ROM) storing the program to be executed by the CPU; a random-access memory (RAM) for use as a working area where the program is to be expanded; and a storage device, such as a memory, to store the program and/or various data. The controller 100 does not necessarily have to be provided inside the printer 10.

Alternatively, the controller 100 may be, for example, a computer external to the printer 10 and connected to the printer 10 so as to enable wire or wireless communication between the controller 100 and the printer 10.

As illustrated in FIG. 3, the controller 100 is configured or programmed to include a memory 101, a scanning control unit 102, a discharge control unit 103, a light source control unit 104, and a movement control unit 105. The controller 100 may further include any processing unit other than those just described, but illustration and description of other processing unit(s) will be omitted.

The memory 101 stores print data. The control units of the controller 100 are configured or programmed to control operations of, for example, the feed motor 33, the carriage motor 54, the recording head 60, and the light sources 72 of the light applicator 70 in accordance with the print data stored in the memory 101.

The scanning control unit 102 controls the carriage mover 50 in accordance with the print data so as to move the carriage 40 in the first scanning direction Y1 and the second scanning direction Y2.

In accordance with the print data, the discharge control unit 103 causes the recording head 60 to discharge ink (which is process color ink, white ink, and gloss ink in this preferred embodiment) during movement of the carriage 40 in the first scanning direction Y1. The printer 10 according to the present preferred embodiment carries out "unidirectional printing" that involves discharging ink only during movement of the carriage 40 in the first scanning direction Y1. "Bidirectional printing" that involves discharging ink during movement of the carriage 40 in the first scanning direction Y1 and the second scanning direction Y2 will be discussed in Second Preferred Embodiment (which will be described below).

The light source control unit 104 controls operations of the light sources 72 during printing. Specifically, the light source control unit 104 turns off the upstream light source group 72*u* and turns on the downstream light source group 72*d* during movement of the carriage 40 in the first scanning direction Y1 and discharge of process color ink from the recording head 60 in accordance with the print data. The light source control unit 104 turns on the upstream light source group 72*u* and the downstream light source group 72*d* during movement of the carriage 40 in the second scanning direction Y2 after discharge of process color ink. In other words, the light source control unit 104 turns on the upstream light source group 72*u* during travel of the carriage 40 in a direction toward the light applicator 70 with respect to the recording head 60. The light source control unit 104 turns off the upstream light source group 72*u* during travel of the carriage 40 in a direction opposite to the light applicator 70. The light source control unit 104 turns on the downstream light source group 72*d* not only during travel of the carriage 40 in the first scanning direction Y1 but also during travel of the carriage 40 in the second scanning direction Y2.

The light source control unit 104 is set to turn off the upstream light source group 72*u* and turn on the downstream light source group 72*d* during movement of the carriage 40 in the first scanning direction Y1 and discharge of gloss ink from the recording head 60 and during movement of the carriage 40 in the second scanning direction Y2 after discharge of gloss ink in accordance with the print data. A mode of controlling the light applicator 70 by the light source control unit 104 differs between when ink to be discharged is process color ink and when ink to be discharged is gloss ink. A more detailed description will be made below about how the light applicator 70 is to be controlled. When white ink is to be discharged, the light source control unit 104 exercises control similar to that for gloss ink. Alternatively, when white ink is to be discharged, the light source control unit 104 may exercise control similar to that for process color ink.

The movement control unit 105 controls operations of the conveyor 30 during printing. Specifically, every time the carriage 40 moves in each of the first scanning direction Y1 and the second scanning direction Y2 at least once, the movement control unit 105 controls the conveyor 30 in accordance with the print data so as to move the recording medium 5 to the downstream side X2 in the conveyance direction X. How many times the carriage 40 moves in the first scanning direction Y1 and the second scanning direction Y2 before movement of the recording medium 5 depends on the print data.

The following description describes a printing method performed by the printer 10 according to the present preferred embodiment in accordance with, by way of example, print data that instructs the printer 10 to form a single print layer using process color ink including cyan ink, magenta ink, yellow ink, and black ink and form, on the print layer, a single topcoat layer using gloss ink. A method for forming a white ink layer is similar to a method for forming a topcoat layer using gloss ink and will thus not be described.

Figure 4:
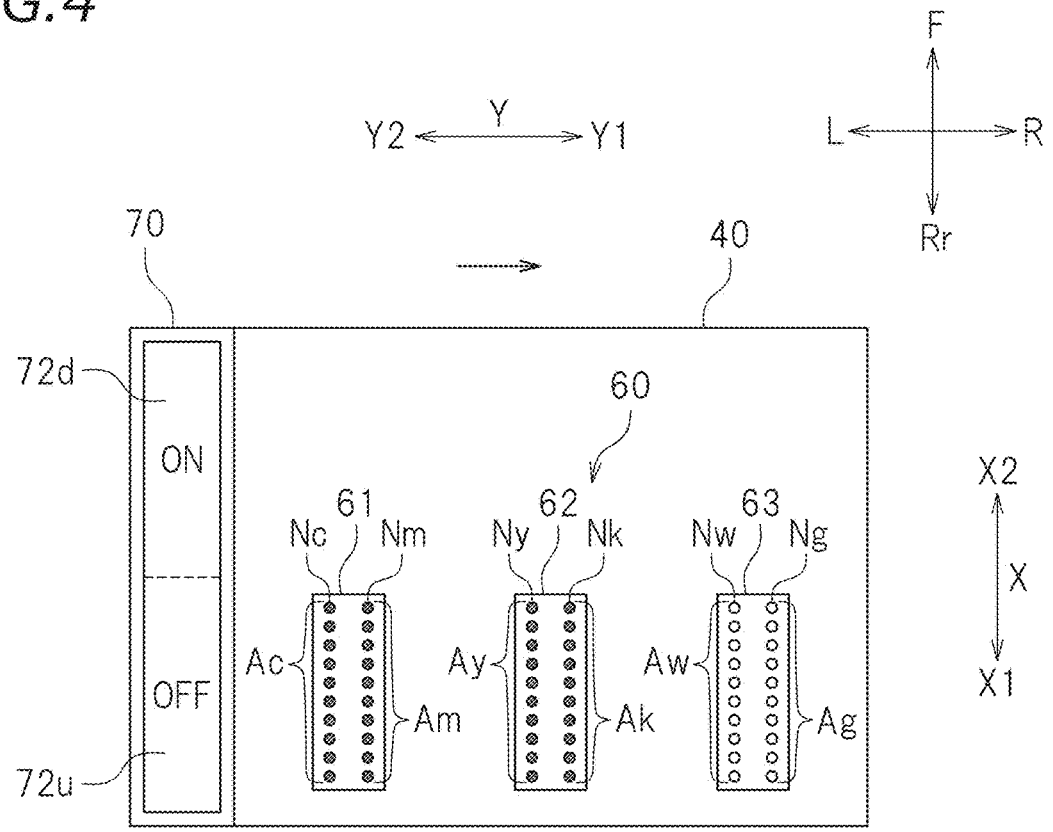
FIG. 4 is a schematic plan view illustrating how a light applicator operates when the printer forms an image while the carriage moves in a first scanning direction.
Figure 5:
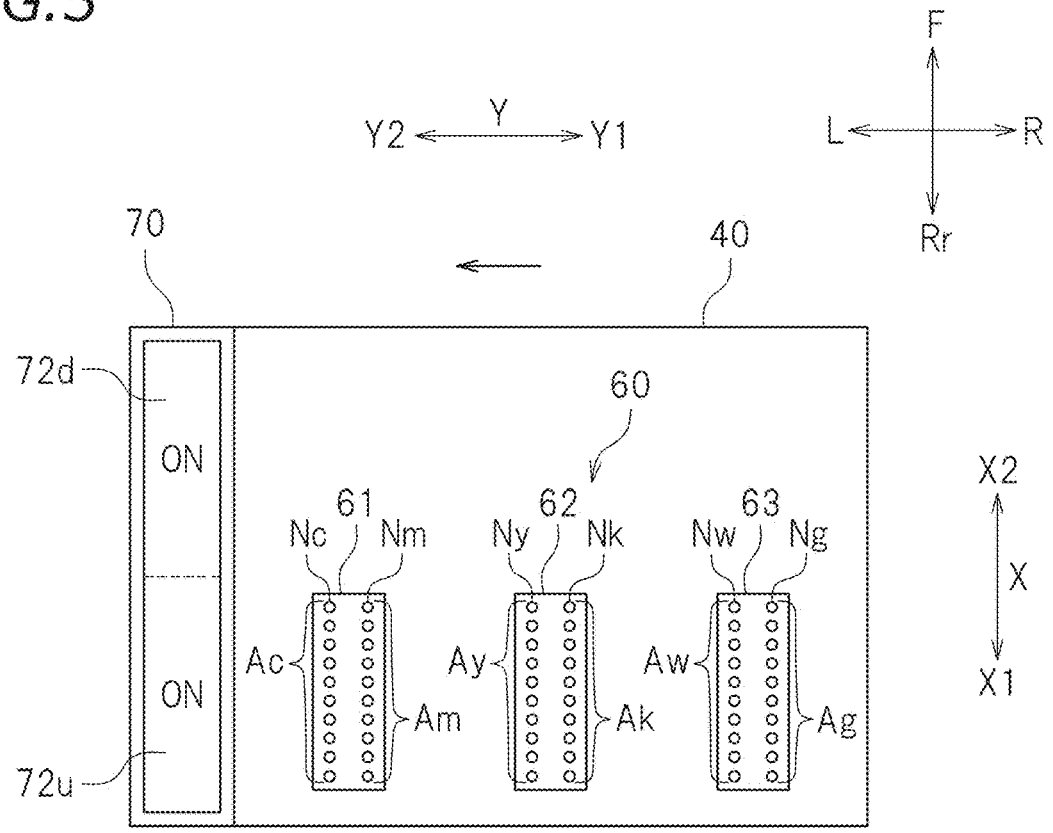
FIG. 5 is a schematic plan view illustrating how the light applicator operates while the carriage moves in a second scanning direction.

FIG. 4 is a schematic plan view illustrating how the light applicator 70 operates when the printer 10 forms an image while the carriage 40 moves in the first scanning direction Y1. FIG. 5 is a schematic plan view illustrating how the light applicator 70 operates while the carriage 40 moves in the second scanning direction Y2. At the point in time illustrated in FIG. 5, the printer 10 is not forming any image and the carriage 40 is moving back in the second scanning direction Y2. The text "ON" in FIGS. 4 and 5 represents that the light source group(s) of the light applicator 70 are/is on, and the text "OFF" represents that the light source group(s) of the light applicator 70 are/is off. As illustrated in FIGS. 4 and 5, the text "ON" is presented on the upstream light source group 72*u* and/or the downstream light source group 72*d* of the light applicator 70 that are/is on, and the text "OFF" is presented on the upstream light source group 72*u* of the light applicator 70 that is off.

Figure 6:
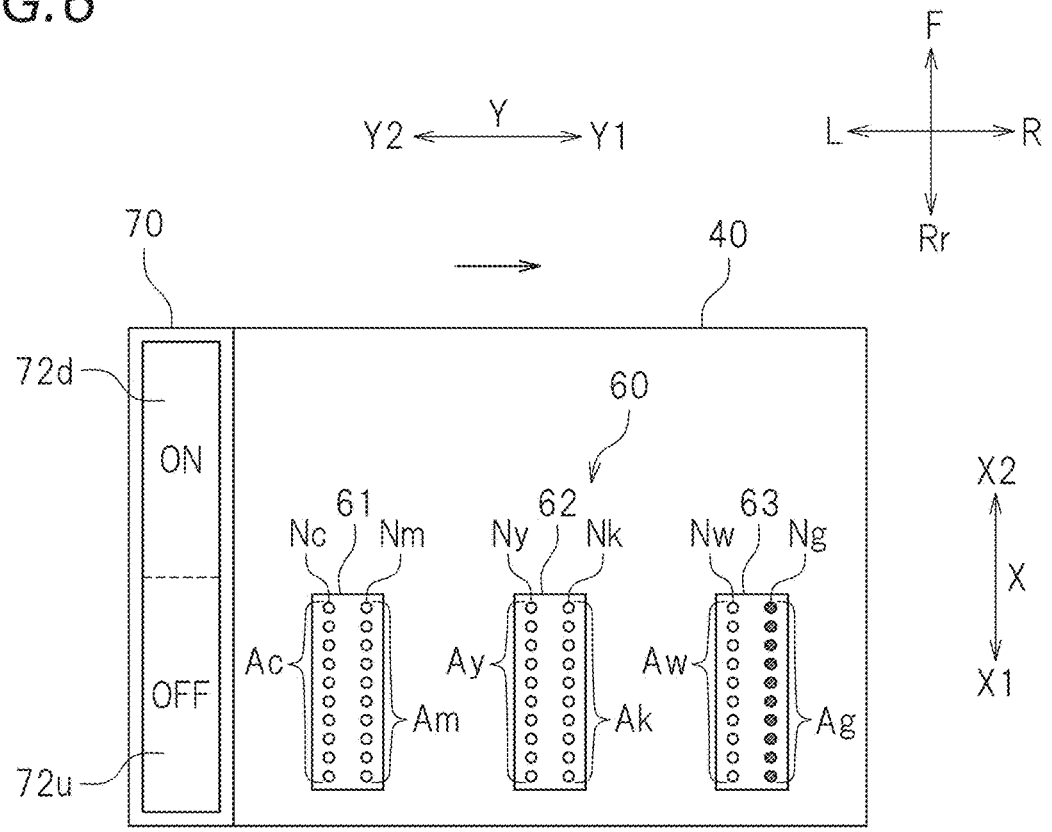
FIG. 6 is a schematic plan view illustrating how the light applicator operates when the printer forms a topcoat layer while the carriage moves in the first scanning direction.
Figure 7:
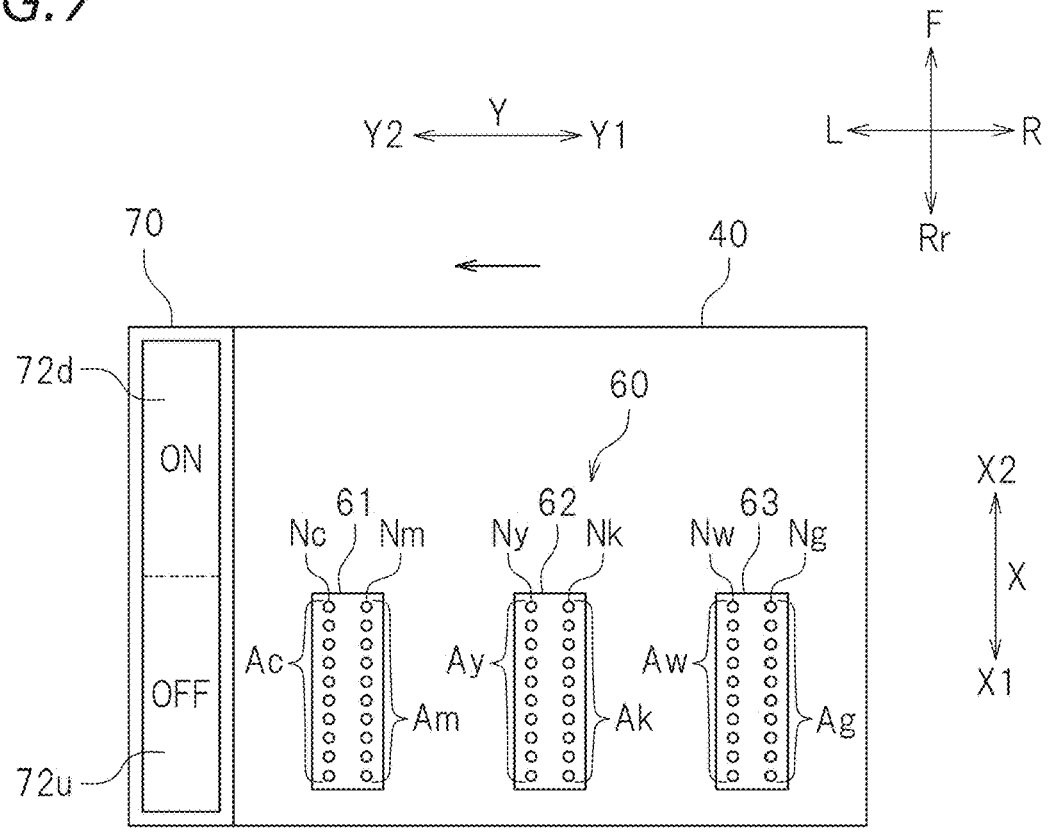
FIG. 7 is a schematic plan view illustrating how the light applicator operates when the printer forms the topcoat layer while the carriage moves in the second scanning direction.

As illustrated in FIGS. 4 and 5, the nozzles Nc to Nk are hatched when process color ink is discharged, and the nozzles Nc to Nk are not hatched when no process color ink is discharged. As illustrated in FIGS. 6 and 7, the nozzles Ng are hatched when gloss ink is discharged, and the nozzles Ng are not hatched when no gloss ink is discharged. The same goes for FIGS. 4 to 12 (except for FIG. 8).

As illustrated in FIG. 4, the present preferred embodiment involves moving the carriage 40 in the first scanning direction Y1 in forming an image. During this movement, process color ink is discharged from the recording head 60. The light applicator 70 is located rearward of the recording head 60 in the direction of travel of the carriage 40 during movement of the carriage 40 in the first scanning direction Y1. As illustrated in FIG. 4, the upstream light source group 72*u* is off at this point in time. Thus, light that will cure process color ink is not applied to the process color ink that has just been discharged from the recording head 60.

As illustrated in FIG. 5, the present preferred embodiment involves moving the carriage 40 in the second scanning direction Y2 after the carriage 40 has moved to the right end of a movable range (which may be an image print range) of the carriage 40, i.e., the end of the movable range in the first scanning direction Y. During this movement, no process color ink is discharged from the recording head 60. Printing performed in the present preferred embodiment is unidirectional printing. The light applicator 70 is located forward of the recording head 60 in the direction of travel of the carriage 40 during movement of the carriage 40 in the second scanning direction Y2. As illustrated in FIG. 5, the upstream light source group 72*u* is on at this point in time. Thus, the light produced by the upstream light source group 72*u* is applied to the process color ink that has been discharged from the recording head 60 at the point in time illustrated in FIG. 4.

When photo-curable ink is semi-cured immediately after having landed on a recording medium and is then fully cured by, for example, the method described in JP 2009-202418 A, a resulting print image may not be glossy enough depending on conditions. This is because if photo-curable ink is semi-cured immediately after having landed on a recording medium, the surfaces of ink dots will be cured but the inner portions of the ink dots will not be cured. If the ink dots flatten in this state, wrinkles may occur at the surfaces of the semi-cured ink dots. The occurrence of such wrinkles makes it impossible to give a desired gloss to a print image. Stacking layers of ink in a semi-cured state makes it more difficult for the inner portions of underlying ink layers to be cured. This promotes the occurrence of a phenomenon in which a desired gloss is not provided to or included in a print image.

Flattening of ink (which means a state where ink wets and spreads) and smoothening of ink (which means a state where an ink surface has few irregularities) are thus not necessarily compatible. As is generally known, if ink does not spread and flatten moderately, printing will be "matte printing", and graininess of ink dots will remain on a print image.

The image printing method according to the present preferred embodiment does not involve applying light to process color ink that has just been discharged (see FIG. 4). This prevents a matte finish from being provided to or included in a print image. Applying light to process color ink that has just been discharged cures ink dots before the ink dots flatten, which often provides a matte finish to a print image.

The image printing method according to the present preferred embodiment involves applying light to process color ink after a lapse of a certain time from discharge of the process color ink (see FIG. 5). This prevents the occurrence of wrinkles caused by flattening ink dots in a semi-cured state as mentioned above. Specifically, the image printing method according to the present preferred embodiment involves applying light to process color ink at the time when the carriage 40 moves back in the second scanning direction Y2 after having moved in the first scanning direction Y1 while discharging process color ink. Applying light in this manner cures process color ink to a degree that the process color ink has substantially no fluidity. This prevents occurrence of wrinkles caused by flattening ink dots in a semi-cured state. Because light is applied to process color ink after a lapse of a certain time from discharge of the process color ink, the process color ink is flattened to a certain degree before being cured. Consequently, a print image is prevented from becoming a matte image.

To apply light at the right time as described above, the present preferred embodiment involves disposing the light applicator 70 at a location opposite to the direction of travel of the carriage 40 with respect to the recording head 60 during ink discharge. When the carriage 40 moves in the direction of travel during ink discharge, the upstream light source group 72u disposed at a location corresponding to the location of the recording head 60 in the conveyance direction X is turned off. When the carriage 40 moves in a direction opposite to the direction of travel during ink discharge, the upstream light source group 72*u* is turned on. Thus, application of light to ink discharged in a preceding pass is carried out immediately before discharge in a next pass, so that an ink leveling (flattening) time is increased or maximized. Applying light in this manner makes it possible to prevent blurring caused by merging of ink dots with those in a preceding pass. As used herein, the term "pass" refers to discharging ink while moving the carriage 40. For unidirectional printing, a single pass corresponds to a single reciprocation of the carriage 40 in the scanning direction Y. For bidirectional printing, a single pass corresponds to one-half of a reciprocation of the carriage 40 in the scanning direction Y (i.e., one-way travel of the carriage 40 in the first scanning direction Y1 or the second scanning direction Y2).

When discharge and curing of process color ink illustrated in FIGS. 4 and 5 have been finished, the printer 10 conveys the recording medium 5 to the downstream side X2 in the conveyance direction X. This updates an image forming position on the recording medium 5 in the conveyance direction X. A distance by which the recording medium 5 is moved in this case may be equal to or slightly shorter than the length of each of the nozzle rows Ac to Ag in the conveyance direction X. However, there is no particular limitation for the distance by which the recording medium 5 is moved. The printing method may involve not only single-pass printing methods but also multi-pass printing methods.

As illustrated in FIGS. 4 and 5, the downstream light source group 72*d* is on not only during travel of the carriage 40 in the first scanning direction Y1 but also during travel of the carriage 40 in the second scanning direction Y2. Thus, the light produced by the downstream light source group 72*d* is applied to an image formed before movement of the recording medium 5 and moved to a position under the downstream light source group 72*d* in accordance with the movement of the recording medium 5. Accordingly, ink dots of process color ink formed before the movement of the recording medium 5 are cured with higher reliability.

The printer 10 repeats the above-described processes the number of times required, thus forming an image of process color ink on the recording medium 5.

Following the formation of the image of process color ink, the present preferred embodiment involves forming a topcoat layer of gloss ink. After the formation of the image of process color ink described above, the printer 10 controls the conveyor 30 so as to return the recording medium 5 to the upstream side X1 in the conveyance direction X. The printer 10 then starts forming a topcoat layer.

FIG. 6 is a schematic plan view illustrating how the light applicator 70 operates when the printer 10 forms a topcoat layer while the carriage 40 moves in the first scanning direction Y1. FIG. 7 is a schematic plan view illustrating how the light applicator 70 operates when the printer 10 forms the topcoat layer while the carriage 40 moves in the second scanning direction Y2. In forming the topcoat layer, the printer 10 in the present preferred embodiment causes the recording head 60 to discharge gloss ink while moving the carriage 40 in the first scanning direction Y1 as illustrated in FIG. 6. As illustrated in FIG. 6, the upstream light source group 72*u* is off at this point in time. Thus, no light is applied to the gloss ink that has just been discharged from the recording head 60.

In the present preferred embodiment, the recording head 60 discharges no gloss ink while the carriage 40 moves in the second scanning direction Y2 as illustrated in FIG. 7. As illustrated in FIG. 7, the upstream light source group 72*u* is off at this point in time. When the printer 10 forms the topcoat layer of gloss ink, the upstream light source group 72*u* is off not only during movement of the carriage 40 in the first scanning direction Y1 but also during movement of the carriage 40 in the second scanning direction Y2.

As illustrated in FIGS. 6 and 7, the downstream light source group 72*d* is on not only during travel of the carriage 40 in the first scanning direction Y1 but also during travel of the carriage 40 in the second scanning direction Y2. Thus, the light produced by the downstream light source group 72*d* is applied to gloss ink discharged before movement of the recording medium 5 and moved to a position under the downstream light source group 72*d* in accordance with the movement of the recording medium 5. Accordingly, ink dots of gloss ink formed before the movement of the recording medium 5 are cured.

In the present preferred embodiment, the upstream light source group 72*u* is not turned on in forming the topcoat layer of gloss ink, thus further increasing the length of time during which gloss ink flattens. Thus, gloss ink flattens to a greater degree, so that the resulting topcoat layer has a higher gloss. For the topcoat layer, there is no need to consider the possibility of mixing and blurring of ink of different colors. Consequently, there would be few problems if the length of time during which gloss ink flattens is longer than the length of time during which process color ink flattens.

In the present preferred embodiment, the upstream light source group 72*u* and the downstream light source group 72*d* are portions of the light applicator 70 adjacent to each other and are substantially continuous with each other in the conveyance direction X. This makes it unlikely for the light applied from the upstream light source group 72*u* and the light applied from the downstream light source group 72*d* to have a boundary region (which is, in other words, a region where the light is weak) therebetween. Thus, the present preferred embodiment reduces the possibility of causing ink to be cured differently between the boundary region and the other region. In the present preferred embodiment, no wall, such as a partition, is present between the upstream light source group 72*u* and the downstream light source group 72*d*. Accordingly, when only the downstream light source group 72*d* is turned on, relatively weak light leaks to the upstream side. Assume that a wall, such as a partition, is present between the upstream light source group 72*u* and the downstream light source group 72*d*. In such a case, almost no light leaks to the upstream side when only the downstream light source group 72*d* is tuned on. When weak light that has leaked to the upstream side as mentioned above is applied to ink dots of gloss ink on the upstream side, the ink dots of gloss ink on the upstream side gradually cures while flattening. Consequently, a gloss ink film (glossy layer) whose surface is smoothened is formable with stability.

Second Preferred Embodiment

An inkjet printer according to a second preferred embodiment of the present invention performs bidirectional printing. Accordingly, the inkjet printer includes additional components, and some of control operations performed by the inkjet printer are changed. Other than these differences, the second preferred embodiment is similar to the first preferred embodiment. In the following description of the second preferred embodiment, components having the same functions as those of the first preferred embodiment will be identified by the same reference signs. Description of features of the second preferred embodiment overlapping those of the first preferred embodiment will be omitted or simplified.

Figure 8:
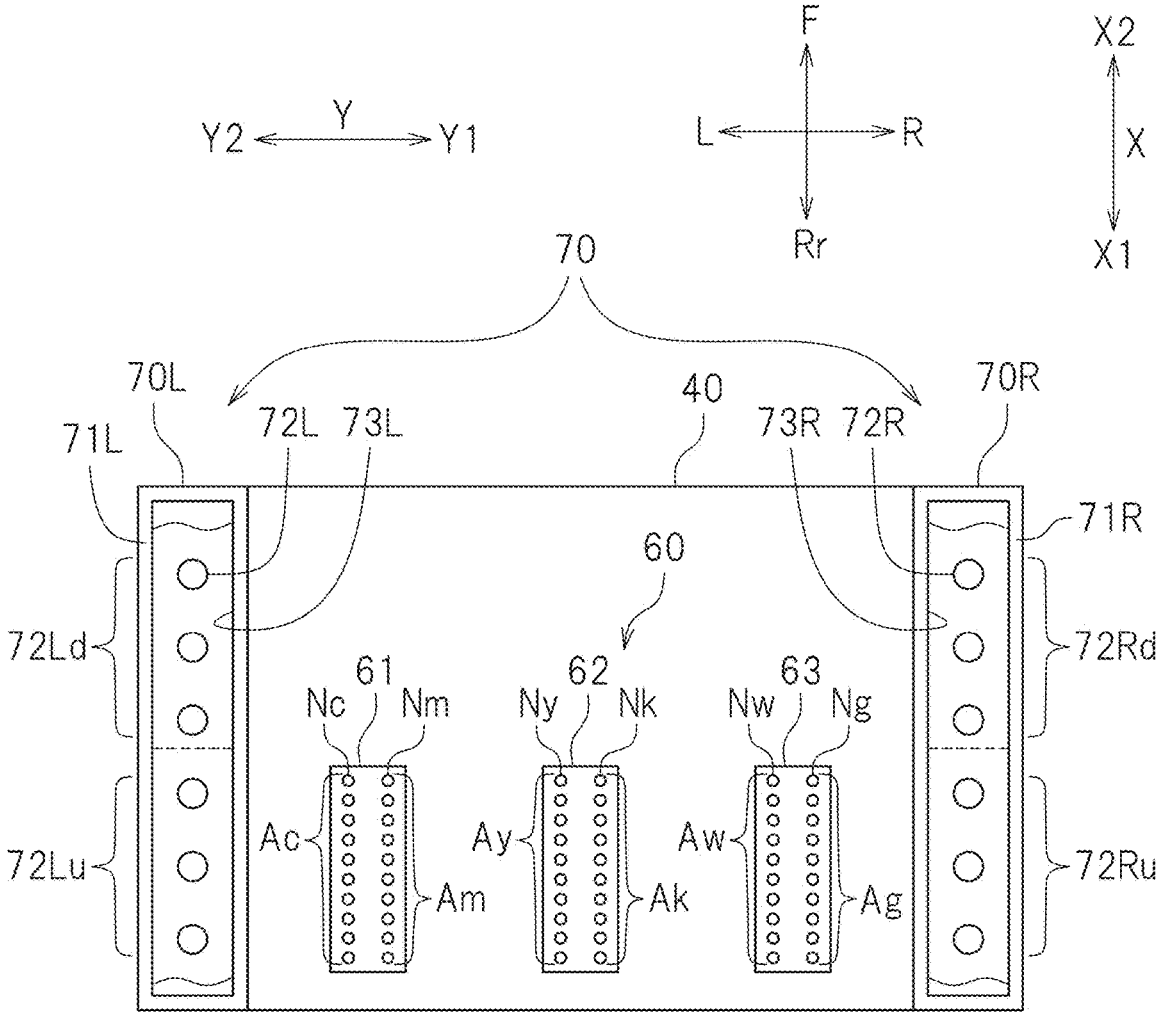
FIG. 8 is a partially cut-away plan view schematically illustrating the arrangement of components on the lower surface of a carriage according to a second preferred embodiment of the present invention.

FIG. 8 is a partially cut-away plan view schematically illustrating the arrangement of components on the lower surface of a carriage 40 according to the second preferred embodiment. As illustrated in FIG. 8, a printer 10 according to the present preferred embodiment includes a first light applicator 70L disposed in a second scanning direction Y2 relative to a recording head 60, and a second light applicator 70R disposed in a first scanning direction Y1 relative to the recording head 60. The first light applicator 70L and the second light applicator 70R are provided on the carriage 40.

The first light applicator 70L is similar to the light applicator 70 according to the first preferred embodiment. The case 71, the light sources 72, and the application port 73 of the light applicator 70 according to the first preferred embodiment respectively correspond to a case 71L, first light sources 72L, and a first application port 73L of the first light applicator 70L according to the second preferred embodiment. The upstream light source group 72*u* and the downstream light source group 72*d* of the light applicator 70 according to the first preferred embodiment respectively correspond to a first upstream light source group 72Lu and a first downstream light source group 72Ld of the first light applicator 70L according to the second preferred embodiment.

The second light applicator 70R is similar to the first light applicator 70L except for the location of the second light applicator 70R with respect to the recording head 60. The second light applicator 70R includes a case 71R, second light sources 72R, and a second application port 73R. The second light sources 72R each produce light that cures ink discharged from the recording head 60. The second light sources 72R include a second upstream light source group 72Ru and a second downstream light source group 72Rd. The second upstream light source group 72Ru is provided at a location corresponding to a location of the recording head 60 in a conveyance direction X. The second upstream light source group 72Ru includes more than one second light source 72R. The second downstream light source group 72Rd is provided on a downstream side X2 in the conveyance direction X relative to the recording head 60. The second downstream light source group 72Rd includes more than one second light source 72R. In the following description of the second preferred embodiment, the first light applicator 70L and the second light applicator 70R may also be collectively referred to as a "light applicator 70".

A discharge control unit 103 according to the present preferred embodiment is set to cause the recording head 60 to discharge ink during movement of the carriage 40 in the first scanning direction Y1 and the second scanning direction Y2 in accordance with print data.

A light source control unit 104 according to the present preferred embodiment is set to turn off the second upstream light source group 72Ru during movement of the carriage 40 in the second scanning direction Y2 and discharge of process color ink from the recording head 60 in accordance with the print data. The light source control unit 104 is set to turn on the second upstream light source group 72Ru during movement of the carriage 40 in the first scanning direction Y1 after discharge of process color ink. When an image is formed using process color ink, the light source control unit 104 controls the first upstream light source group 72Lu in a manner similar to that in which the upstream light source group 72*u* is controlled in the first preferred embodiment.

In the present preferred embodiment, the light source control unit 104 turns on the first downstream light source group 72Ld and the second downstream light source group 72Rd when an image is formed using process color ink. Alternatively, the light source control unit 104 may be configured or programmed to turn on at least one of the first downstream light source group 72Ld and the second downstream light source group 72Rd when an image is formed using process color ink.

The light source control unit 104 turns off both of the first upstream light source group 72Lu and the second upstream light source group 72Ru when a topcoat layer is formed using gloss ink. The light source control unit 104 turns on the first downstream light source group 72Ld and the second downstream light source group 72Rd when a topcoat layer is formed using gloss ink. Alternatively, the light source control unit 104 may turn on at least one of the first downstream light source group 72Ld and the second downstream light source group 72Rd.

The following description discusses a case where an image layer including process color ink layers is formed and then a topcoat layer including gloss ink layers is formed on the image layer.

Figure 9:
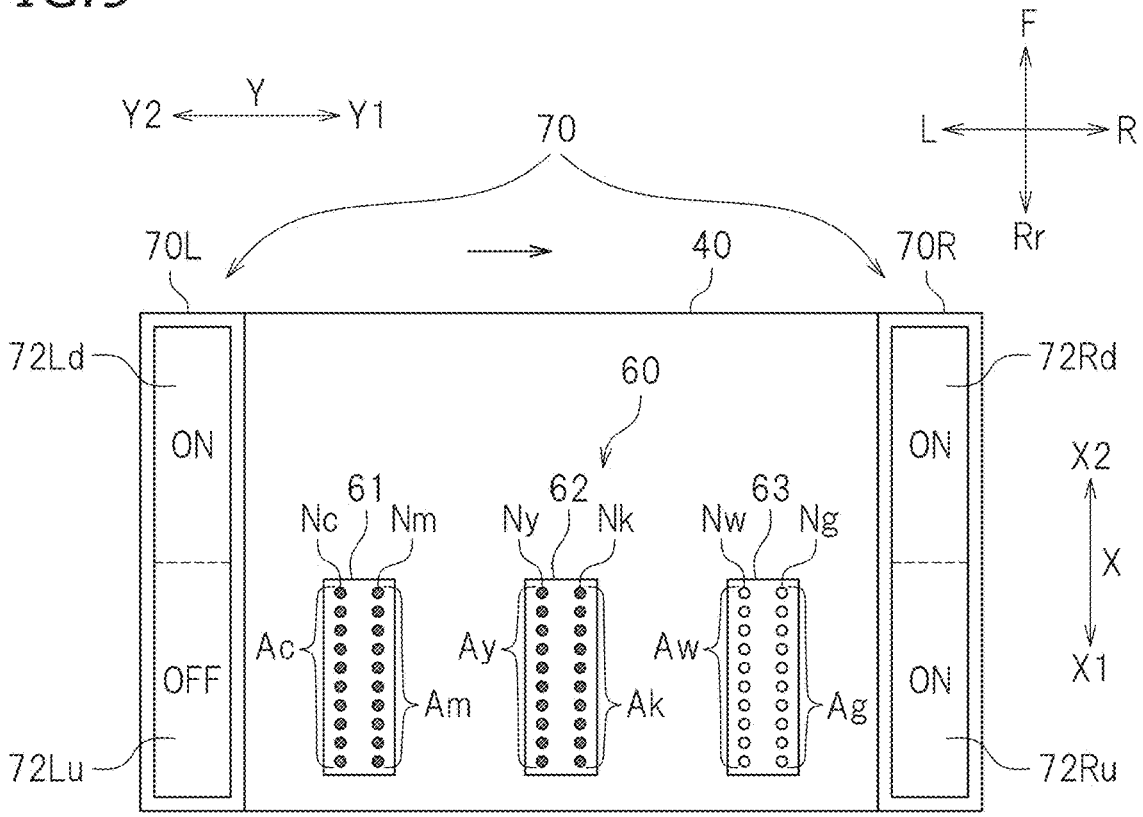
FIG. 9 is a schematic plan view illustrating how a light applicator operates in the second preferred embodiment when a printer forms an image while the carriage moves in a first scanning direction.
Figure 10:
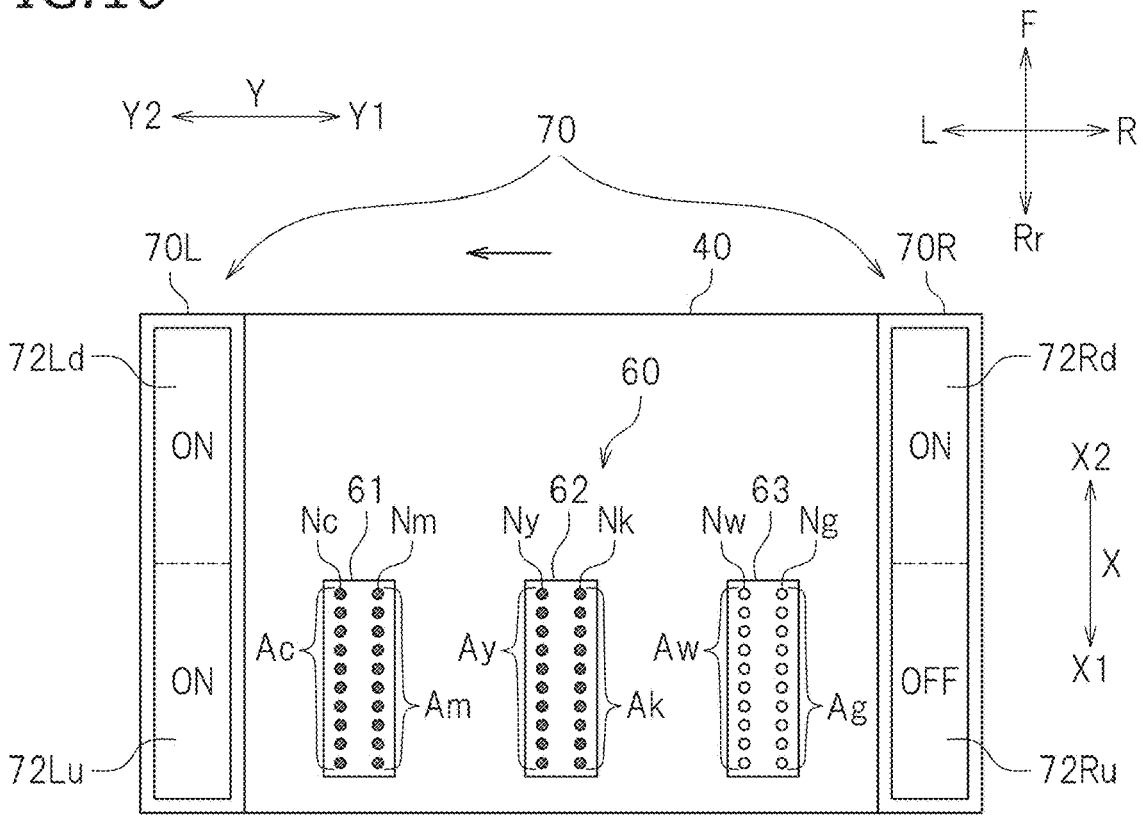
FIG. 10 is a schematic plan view illustrating how the light applicator operates in the second preferred embodiment when the printer forms the image while the carriage moves in a second scanning direction.

FIG. 9 is a schematic plan view illustrating how the light applicator 70 operates in the present preferred embodiment when the printer 10 forms an image while the carriage 40 moves in the first scanning direction Y1. FIG. 10 is a schematic plan view illustrating how the light applicator 70 operates in the present preferred embodiment when the printer 10 forms the image while the carriage 40 moves in the second scanning direction Y2. As illustrated in FIG. 9, the printer 10 according to the present preferred embodiment causes the recording head 60 to discharge process color ink while moving the carriage 40 in the first scanning direction Y1 when the printer 10 forms the image. As illustrated in FIG. 9, the first upstream light source group 72Lu is off at this point in time. Thus, light that will cure process color ink is not applied to the process color ink that has just been discharged from the recording head 60.

As illustrated in FIG. 9, the second upstream light source group 72Ru is on at this point in time. Thus, light is applied to process color ink discharged while the carriage 40 is moved in the second scanning direction Y2 in a pass immediately preceding the point in time in FIG. 9. The present preferred embodiment involves turning on the second upstream light source group 72Ru, so that the process color ink discharged while the carriage 40 is moved in the second scanning direction Y2 in the pass immediately preceding the point in time in FIG. 9 is flattened moderately and smoothened suitably as in the first preferred embodiment.

During movement of the carriage 40 in the second scanning direction Y2, the first scanning direction Y1 and the second scanning direction Y2 are reversed. As illustrated in FIG. 10, the printer 10 causes the recording head 60 to discharge process color ink also during movement of the carriage 40 in the second scanning direction Y2. As illustrated in FIG. 10, the second upstream light source group 72Ru is off and the first upstream light source group 72Lu is on at this point in time.

As illustrated in FIGS. 9 and 10, the first downstream light source group 72Ld and the second downstream light source group 72Rd are on during travel of the carriage 40 in both of the first scanning direction Y1 and the second scanning direction Y2. Thus, the light produced by the first downstream light source group 72Ld and the second downstream light source group 72Rd is applied to ink dots of process color ink formed before movement of a recording medium 5 and moved to positions under the first downstream light source group 72Ld and the second downstream light source group 72Rd in accordance with the movement of the recording medium 5. This compensates for a reduction in accumulated light quantity caused by turning off the first upstream light source group 72Lu or the second upstream light source group 72Ru, making it possible to apply light of an accumulated light quantity necessary for curing to ink. Accordingly, ink dots of process color ink formed before the movement of the recording medium 5 are cured with higher reliability.

Figure 11:
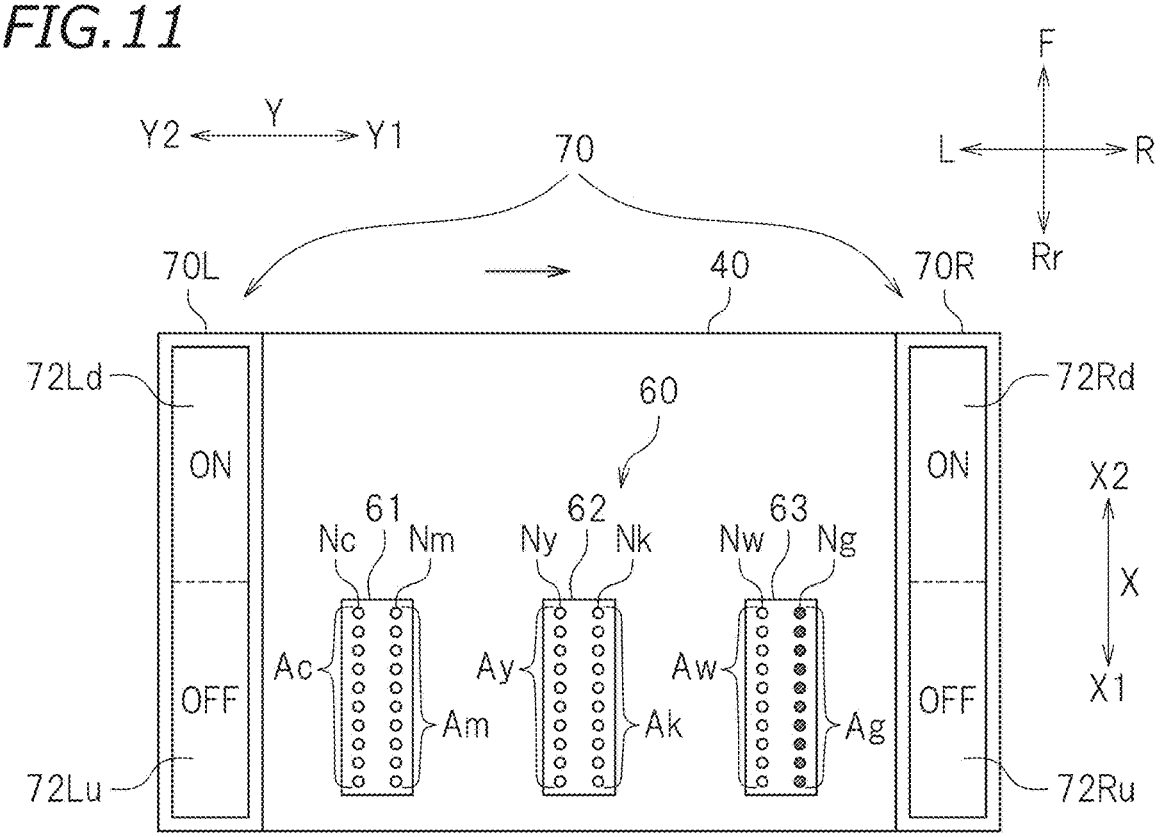
FIG. 11 is a schematic plan view illustrating how the light applicator operates in the second preferred embodiment of the present invention when the printer forms a topcoat layer while the carriage moves in the first scanning direction.
Figure 12:
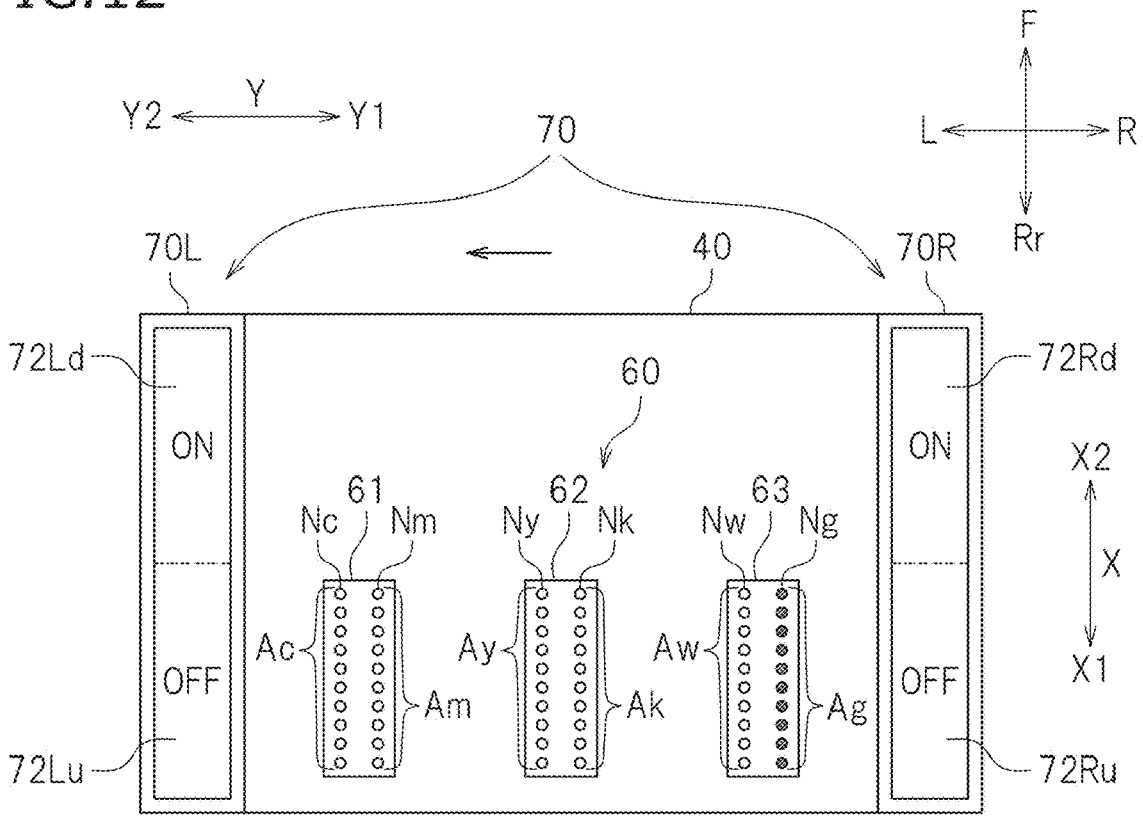
FIG. 12 is a schematic plan view illustrating how the light applicator operates in the second preferred embodiment of the present invention when the printer forms the topcoat layer while the carriage moves in the second scanning direction.

FIG. 11 is a schematic plan view illustrating how the light applicator 70 operates when the printer 10 forms a topcoat layer while the carriage 40 moves in the first scanning direction Y1. FIG. 12 is a schematic plan view illustrating how the light applicator 70 operates when the printer 10 forms the topcoat layer while the carriage 40 moves in the second scanning direction Y2. As illustrated in FIG. 11, the printer 10 in the present preferred embodiment causes the recording head 60 to discharge gloss ink while moving the carriage 40 in the first scanning direction Y1 when the printer 10 forms the topcoat layer. As illustrated in FIG. 11, the first upstream light source group 72Lu and the second upstream light source group 72Ru are off at this point in time. Thus, no light is applied to the gloss ink that has just been discharged from the recording head 60.

As illustrated in FIG. 12, the present preferred embodiment involves causing the recording head 60 to discharge gloss ink also during movement of the carriage 40 in the second scanning direction Y2. In the present preferred embodiment, the first upstream light source group 72Lu and the second upstream light source group 72Ru are off also during this process as illustrated FIG. 12. When the printer 10 forms the topcoat layer using gloss ink, the first upstream light source group 72Lu and the second upstream light source group 72Ru are off during movement of the carriage 40 in both of the first scanning direction Y1 and the second scanning direction Y2. As illustrated in FIGS. 11 and 12, the first downstream light source group 72Ld and the second downstream light source group 72Rd are on during travel of the carriage 40 in both of the first scanning direction Y1 and the second scanning direction Y2 when the printer 10 forms the topcoat layer. Thus, the light produced by the first downstream light source group 72Ld and the second downstream light source group 72Rd is applied to gloss ink discharged before movement of the recording medium 5 and moved to positions under the first downstream light source group 72Ld and the second downstream light source group 72Rd in accordance with the movement of the recording medium 5. Accordingly, ink dots of gloss ink formed before the movement of the recording medium 5 are cured. This effect is similar to that achieved in the first preferred embodiment.

As described above, the printer 10 according to the second preferred embodiment is able to perform printing similar to that performed in the first preferred embodiment also when the printer 10 performs unidirectional printing.

In the second preferred embodiment, no distinction is necessary between the first scanning direction Y1 and the second scanning direction Y2 as far as printing is concerned. Accordingly, the above description holds true if the first scanning direction Y1 mentioned in the second preferred embodiment is read as the "second scanning direction" and the second scanning direction Y2 mentioned in the second preferred embodiment is read as the "first scanning direction".

Some of preferred embodiments of the present invention have been described thus far. The preferred embodiments described above, however, are only illustrative. The techniques disclosed herein may be carried out in various other forms.

In the foregoing preferred embodiments, for example, control exercised on the light applicator 70 in forming a layer of ink other than process color ink (or more specifically, a layer of gloss ink or a layer of white ink) differs from control exercised on the light applicator 70 in forming a layer of process color ink. Control exercised on the light applicator 70 in forming a layer of ink other than process color ink, however, may be similar to control exercised on the light applicator 70 in forming a layer of process color ink.

Although the description of the foregoing preferred embodiments has focused on the case where the printer provides a gloss to a print image, the printer may be configured to allow selection of any other print mode, such as a matte print mode.

Although the locations of the nozzle rows Ac to Ag correspond to each other in the conveyance direction X in the foregoing preferred embodiments, the locations of the nozzle rows Ac to Ag do not necessarily correspond to each other in the conveyance direction X. The nozzles may be disposed in a "staggered arrangement", and the locations of some or all of the nozzle rows Ac to Ag may differ in the conveyance direction X.

Unless otherwise specified, the inkjet printer is not limited to any particular configuration, structure or arrangement. The techniques disclosed herein, for example, may be applicable to any type of inkjet printer, such as a flatbed inkjet printer. The techniques disclosed herein, for example, may be applicable to an apparatus, such as an inkjet printer with a cutting head, a portion of which incorporates an inkjet printer.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer comprising:

a support table on which a recording medium is to be placed;

a carriage facing the support table;

a medium mover to move the recording medium placed on the support table in a predetermined movement direction relative to the carriage;

a carriage mover to move the carriage in a first scanning direction and a second scanning direction perpendicular or substantially perpendicular to the movement direction of the recording medium;

a recording head provided on the carriage and including first nozzles each to discharge photo-curable first ink toward the support table, the first ink is process color ink;

a first light applicator provided on the carriage and including first light sources each to produce light that cures the first ink; and a controller to control the medium mover, the carriage mover, the recording head, and the first light applicator; wherein the first light applicator is disposed in the second scanning direction relative to the recording head;

the first light sources include:

a first upstream light source group provided at a location corresponding to a location of the recording head in the movement direction of the recording medium, the first upstream light source group including one or more of the first light sources; and a first downstream light source group provided on a downstream side in the movement direction relative to the recording head, the first downstream light source group including one or more of the first light sources; and the controller is configured or programmed to include:

a memory to store print data;

a scanning controller to control the carriage mover in accordance with the print data so as to move the carriage in the first scanning direction and the second scanning direction;

a discharge controller to cause the recording head to discharge the first ink at least during movement of the carriage in the first scanning direction in accordance with the print data;

a light source controller to turn off the first upstream light source group and turn on the first downstream light source group during movement of the carriage in the first scanning direction and discharge of the first ink from the recording head in accordance with the print data, and to turn on the first upstream light source group and the first downstream light source group during movement of the carriage in the second scanning direction after discharge of the first ink in accordance with the print data; and a movement controller to control the medium mover in accordance with the print data so as to move the recording medium to the downstream side in the movement direction every time the carriage moves in each of the first scanning direction and the second scanning direction at least once.

2. The inkjet printer according to claim 1, further comprising a second light applicator provided on the carriage and including second light sources each to produce light that cures the first ink, wherein the second light applicator is disposed in the first scanning direction relative to the recording head;

the second light sources include:

a second upstream light source group provided at a location corresponding to the location of the recording head in the movement direction of the recording medium, the second upstream light source group including one or more of the second light sources; and a second downstream light source group provided on the downstream side in the movement direction relative to the recording head, the second downstream light source group including one or more of the second light sources;

the discharge controller is configured or programmed to cause the recording head to discharge the first ink during movement of the carriage in the first scanning direction and the second scanning direction in accordance with the print data; and the light source controller is configured or programmed to turn off the second upstream light source group during movement of the carriage in the second scanning direction and discharge of the first ink from the recording head in accordance with the print data, and to turn on the second upstream light source group during movement of the carriage in the first scanning direction after discharge of the first ink in accordance with the print data.

3. The inkjet printer according to claim 2, wherein the light source controller is configured or programmed to turn on the second downstream light source group during movement of the carriage in the second scanning direction and discharge of the first ink from the recording head in accordance with the print data and during movement of the carriage in the first scanning direction after discharge of the first ink in accordance with the print data.

4. The inkjet printer according to claim 1, wherein the recording head further includes second nozzles each to discharge photo-curable second ink toward the support table, the second ink is special color ink;

the discharge controller is configured or programmed to cause the recording head to discharge the first ink or the second ink at least during movement of the carriage in the first scanning direction in accordance with the print data; and the light source controller is configured or programmed to turn off the first upstream light source group and turn on the first downstream light source group during movement of the carriage in the first scanning direction and discharge of the second ink from the recording head and during movement of the carriage in the second scanning direction after discharge of the second ink in accordance with the print data.

5. The inkjet printer according to claim 4, wherein the second ink is transparent ink.

* * * * *